US005989158A

United States Patent [19]

Fredette

[11] Patent Number: 5,989,158

[45] Date of Patent: Nov. 23, 1999

[54] EXERCISE BAR ASSEMBLY

[76] Inventor: Bernard Fredette, 10 chemin Du Lac, Lévy, Quebec, Canada, J6N 1A1

[21] Appl. No.: 08/994,012

[22] Filed: Dec. 18, 1997

[51] Int. Cl.[6] ..... A63B 1/00

[52] U.S. Cl. ..... 482/38; 482/36; 482/39

[58] Field of Search ..... 482/14–18, 23, 482/33–42

[56] References Cited

U.S. PATENT DOCUMENTS

| | | | |
|---|---|---|---|
| 1,085,486 | 1/1914 | Rosenberger . | |
| 1,104,505 | 6/1914 | Holworthy . | |
| 3,384,368 | 5/1968 | Fenner et al. . | |
| 3,525,521 | 8/1970 | Sylvester . | |
| 3,642,278 | 2/1972 | Hinckley . | |
| 3,707,285 | 12/1972 | Martin | 482/38 |
| 4,448,412 | 5/1984 | Brentham | 482/112 |
| 4,934,693 | 6/1990 | Santoro | 482/98 |
| 5,403,269 | 4/1995 | Kennedy | 482/122 |

FOREIGN PATENT DOCUMENTS 1447999 6/1966 France .

*Primary Examiner*—Glenn E. Richman
*Attorney, Agent, or Firm*—Ronald S. Kosie; Robert Brouillette; Nicolas Pellemans

[57] ABSTRACT

A horizontal bar exercising device for use in a room having a floor and a ceiling, the device comprising first and second support posts designed to extend vertically between the floor and ceiling and a horizontal bar having first and second ends interconnected with the first and second posts respectively by sleeve members, the sleeve being slidable along the first and second posts by means of friction reducing means interposed therebetween to minimize binding between the sleeves and posts. The device preferably includes extension arms located at the upper distal end, each of the extension arms having a pressure rod to indicate a preset pressure to be applied to the ceiling.

20 Claims, 5 Drawing Sheets

12
16
18
28
10
10'
14
56
56'
14
90
64
84
80'
82
80
11

EXERCISE BAR ASSEMBLY

FIELD OF THE INVENTION

The present invention relates to an exercising device and more particularly, it relates to an exercising device having a horizontal bar extending between first and second vertical posts.

The use of home exercise equipment is becoming wide spread as the public has increasing concern about their physical well being. Many different types of home exercise devices are known including treadmills, stationary bicycles, various resistance training devices such as weight lifting equipment, etc. Among the more basic and inexpensive types of equipment is that which is known as the horizontal bar and which can be used to perform a variety of exercises.

Different types of devices which provide a horizontal bar are well known in the art. The devices range from horizontal bars provided as a part of fairly complex resistance training apparatus those which function as a stand alone unit. These stand alone units generally comprise vertically extending posts having a horizontal bar extending therebetween and secured to the posts by various means.

An example of such a device is that shown in U.S. Pat. No. 3,642,278 which teaches a horizontal bar exercising device having vertical posts with a horizontal bar extending therebetween. A similar device is illustrated in U.S. Pat. No. 1,085,486.

While the prior art devices are functional for various uses, there are certain disadvantages. Thus, it would be desirable to provide a device wherein the device would be functional for installation within a wide range of ceiling heights and wherein it can be used in a typical residential room wherein gypsum boards are provided as a ceiling finish.

SUMMARY OF THE INVENTION

It is an object of the present invention to provide a horizontal bar exercise device which is functional over a wide range of ceiling heights.

It is a further object of the present invention to provide a horizontal bar exercise device wherein the adjustment of the horizontal bar from one height to another height is easily accomplished.

It is a further object of the present invention to provide a horizontal bar exercise device which may be used in most residential environments including those having gypsum board ceilings.

According to one aspect of the present invention, there is provided a horizontal bar exercising device for use in a room having a floor and a ceiling, the device comprising first and second support posts designed to extend vertically between the floor and ceiling, a horizontal bar having first and second ends, first and second sleeve members, the first sleeve member interconnecting the first post and the first end of the horizontal bar, the second sleeve member interconnecting the second post and the second end of the horizontal bar, the sleeves being slidable vertically along the first and second posts, each of the sleeve members having friction reducing means interposed between the sleeve and the posts to thereby permit movement of the horizontal bar and sleeves to minimize binding therebetween.

The support posts are preferably arranged to come in two different portions with the portions being interconnected together by means of a dowel like arrangement. The posts are preferably cut at a vertical angle so that self alignment is achieved.

In preferred embodiments, each of the posts has an extension arm telescopically arranged with respect to the post and which is vertically moveable. A locking means prevents the extension arm from withdrawing back into the support post once it has been extended.

Pressure rods are preferably spring biased such that a predetermined amount of force may be applied to retain the posts in the vertical position.

A locking arrangement for locking the sleeve and the horizontal bar in a desired position are described.

The present invention in an aspect provides in a horizontal bar exercising, device for use in a room having a floor and a ceiling, the device comprising first and second support posts, a horizontal bar having first and second ends, and connecting means connecting said horizontal bar at each end thereof to a respective support post, said first and second support posts being designed to extend vertically between said floor and ceiling, said support posts each having a ceiling end and a floor end, the improvement wherein said device comprises a pair of extension arms, a pair extension arm displacement means and a pair of releasable locking means each support post having a tubular configuration such that the support post has an interior communicating with an opening at said ceiling end, each extension arm being telescopically mounted with respect to the interior of a respective support post, each releasable locking means being associated with a respective extension arm for locking the extension arm in an extended position, each extension arm displacement means being associated with a respective extension arm for urging the respective extension arm out of the interior of the respective post through the opening at the ceiling end thereof to an extended position.

In accordance with the present invention there is provided in a horizontal bar exercising, device for use in a room having a floor and a ceiling, the device comprising first and second support posts, a horizontal bar having first and second ends, and connecting means connecting said horizontal bar at each end thereof to a respective support post, said first and second support posts being designed to extend vertically between said floor and ceiling, said support posts each having a ceiling end and a floor end, the improvement wherein said device comprises a pair of extension arms, and a pair of releasable locking means each releasable locking means being associated with a respective extension arm for locking the extension arm in an extended position, each extension arm being associated with a respective cable means and a respective cable mounting means, each support post having a tubular configuration such that the support post has an interior communicating with an opening at said ceiling end, each extension arm being telescopically mounted with respect to the interior of a respective support post, the cable means and the cable mounting means associated with each extension arm being configured and disposed such that a portion of the cable means is exterior of a respective post and the cable means extends into the interior of the respective post and engages the respective extension arm such that by pulling on the portion of the cable means exterior of the respective post such pulling induces the cable means to urge the respective extension arm out of the interior of the respective post through the opening at the ceiling end thereof to an extended position.

In accordance with the present invention each releasable locking means associated with a respective extension arm may comprise a pivotally mounted lever member and spring bias means, said lever member and spring bias means being configured and mounted on a respective support post such that said lever element is displaceable between an arm locking configuration wherein a contact element of the lever member is biassed in locking contact with the extension arm and an arm release configuration wherein the contact element is spaced form said extension arm.

In accordance with the present invention pulley means may be located at the ceiling end of each of said support posts, the cable means associated with each extension arm extending from a lower end of a respective extension arm about a respective pulley means to a location exterior of a respective post.

In accordance with the present invention each extension arm may comprise a sleeve element and a pressure rod element telescopically mounted within said sleeve element, said pressure rod element being biassed outwardly at a distal end of said sleeve element. Each of pressure rod element may be biassed outwardly by a spring means located within a respective sleeve element.

In accordance with the present invention the device may comprise a pressure beam designed to engage the ceiling and extending between distal ends of said extension arms.

In accordance with the present invention the connecting means may comprise first and second sleeve members, a pair of releasable locking components, and first and second friction reducing means, said first sleeve member interconnecting said first post and said first end of said horizontal bar, said second sleeve member interconnecting said second post and said second end of said horizontal bar, said sleeve members being respectively slidable along said first and second posts, said first and second friction reducing means each being interposed between a respective sleeve member and a respective post, and each releasable locking component being associated with a respective end of the horizontal bar for locking the respective end of the horizontal bar to a respective support post in predetermined position.

In accordance with the present invention the first and second friction reducing means may each comprise glide members on an interior surface of a respective sleeve member.

In accordance with the present invention the first and second friction reducing means may each comprise four spaced apart glide elements, each glide element comprising an upper glide member and a lower glide member, each upper glide member being vertically aligned with and vertically spaced apart from a respective lower glide member so as to define a respective glide element.

In accordance with the present invention each of the support posts may have a plurality of vertically aligned lock apertures, said vertically aligned lock apertures being disposed so as to be between a pair of guide elements.

In accordance with the present invention each of the support posts may have a plurality of vertically aligned lock apertures, and each of the releasable locking components may comprise said vertically aligned lock apertures of a respective support post, a further sleeve member slidable along said horizontal bar, a pivotally mounted locking member disposed at a respective end of the horizontal bar, said locking member having a locking pin extended therefrom configured to fit within the lock apertures of the respective support post, said further sleeve member being connected by connecting means to the locking member, biassing means, the locking member, the further sleeve member, the biassing means and a respective sleeve member interconnecting the respective support post and the horizontal bar being configured and mounted such that the locking member is displaceable by the further sleeve member between a locking configuration wherein the locking pin thereof is biassed in locking engagement within a lock aperture and an extracted configuration wherein the locking pin is an extracted position relative to said apertures such that respective sleeve member interconnecting the respective support post and the horizontal bar is permitted to vertically slide along the respective support post.

In accordance with the present invention each of the support posts may comprise an upper portion and a lower portion, said portions being secured together by means of a dowel extending from one of said portions to within another of said portions, one of said portions having a end cut at an angle with respect to the horizontal and the other of said portions having the dowel and having a ledge element of complimentary shape and angle to that of the cut end so as to engage the cut end so as to thereby permit self-aligning of the locking apertures of each of said portions.

In accordance with a further aspect the present invention provides in a horizontal bar exercising device for use in a room having a floor and a ceiling, the device comprising first and second support posts, a horizontal bar having first and second ends, and connecting means connecting said horizontal bar at each end thereof to a respective support post, and said first and second support posts being designed to extend vertically between said floor and ceiling, said support posts each having a ceiling end and a floor end, said connecting means comprising first and second sleeve members, said first sleeve member interconnecting said first post and said first end of said horizontal bar, said second sleeve member interconnecting said second post and said second end of said horizontal bar, said sleeve members being respectively slidable along said first and second posts, the improvement wherein said connecting means comprises a pair of releasable locking components, each releasable locking component being associated with a respective end of the horizontal bar for locking the respective end of the horizontal bar to a respective support post in predetermined position, and wherein each of said support posts has a plurality of vertically aligned lock apertures, wherein each of said releasable locking components comprises the vertically aligned lock apertures of a respective support post, a further sleeve member slidable along said horizontal bar, a pivotally mounted locking member disposed at a respective end of the horizontal bar, said locking member having a locking pin extended therefrom configured to fit within the lock apertures of the respective support post, said further sleeve member being connected by connecting means to said locking member, and biassing means, the locking member, the further sleeve member, the biassing means and a respective sleeve member interconnecting the respective support post and the horizontal bar being configured and mounted such that the locking member is displaceable by the further sleeve member between a locking configuration wherein the locking pin thereof is biassed in locking engagement within a lock aperture and an extracted configuration wherein the locking pin is an extracted position relative to said apertures such that respective sleeve member interconnecting the respective support post and the horizontal bar is permitted to vertically slide along the respective support post.

In accordance with the further aspect of the present invention each of the support posts may comprise an upper portion and a lower portion as described herein.

In accordance with the further aspect of the present invention the connecting means may comprise first and second friction reducing means as described herein.

In accordance with the further aspect of the present invention the first and second friction reducing means may each comprises four spaced apart glide elements as described herein.

Having thus generally described the invention, reference will be made to the accompanying drawings illustrating an embodiment thereof, in which:

DESCRIPTION OF THE PREFERRED EMBODIMENTS

Figure 1:
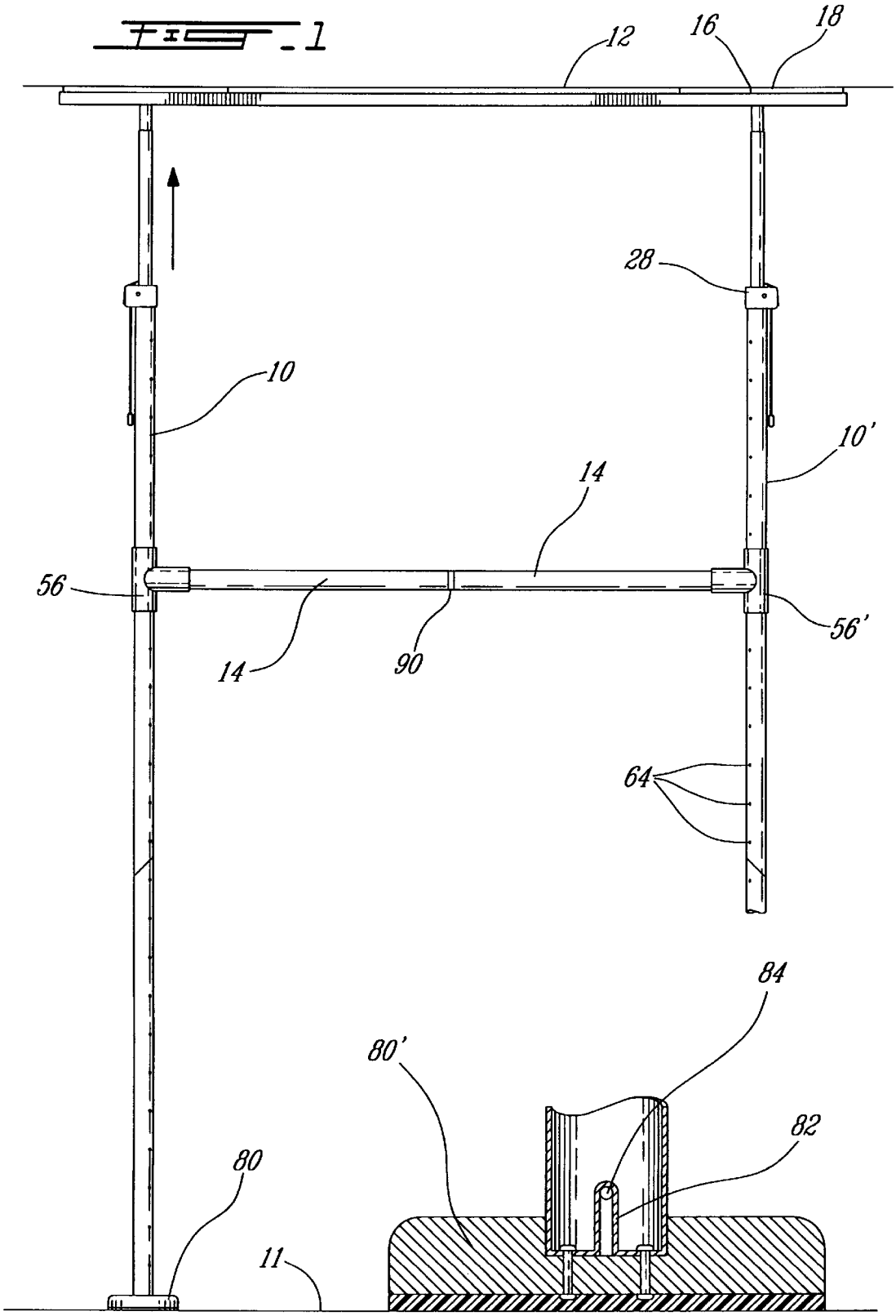
FIG. 1 is a side elevational view, partially in cut-away of an embodiment of a horizontal bar exercise device according to the present invention.

Referring to the drawings in greater detail and by reference characters thereto, the horizontal bar exercise device according to the present invention includes first and second vertical support posts 10 and 10' and having a horizontal exercise bar 14 extending therebetween. Posts 10 and 10' are designed to extend between a floor 11 and a ceiling 12. When erected, posts 10 and 10', in the illustrated embodiment, are adapted to contact a pressure beam 16 to distribute the force exerted by vertical posts 10 and 10' over a wide area. Cushioning 18 may be provided between pressure beam 16 and ceiling 12; pressure beam 16 extends between distal ends of the extension arms described below.

Figure 2:
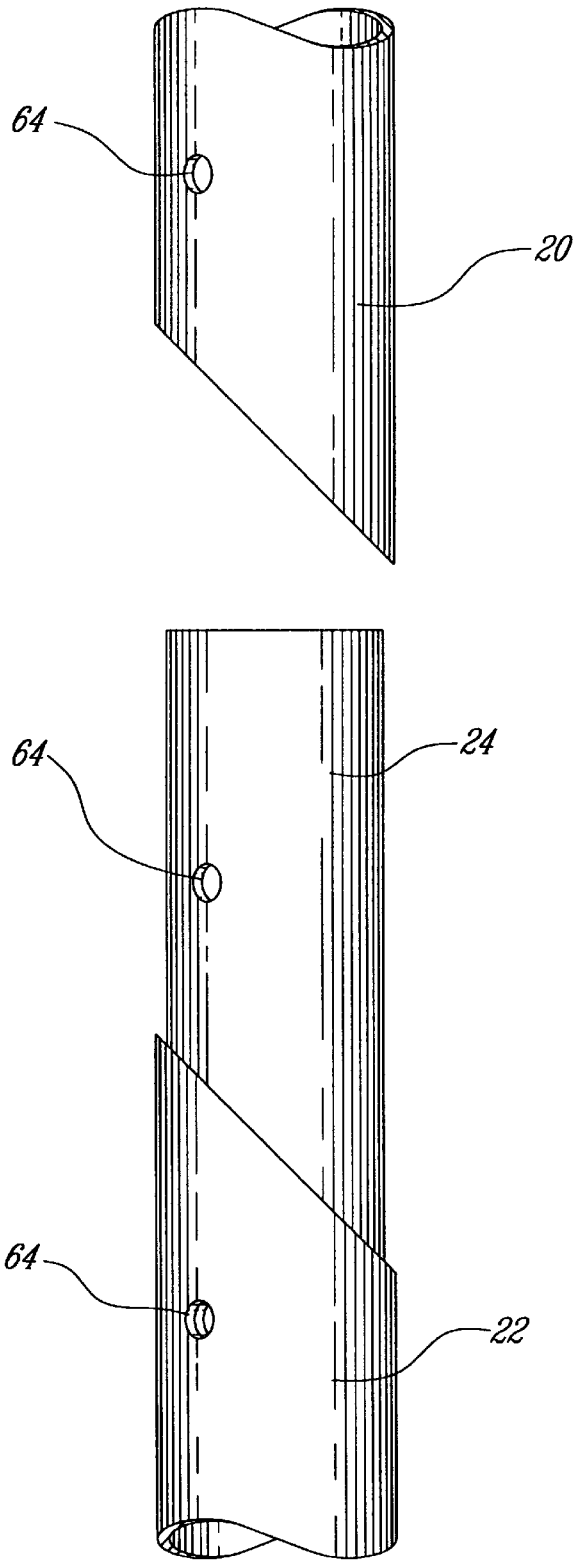
FIG. 2 is a detailed side view of the joining of the sectional vertical posts.
Figure 3A:
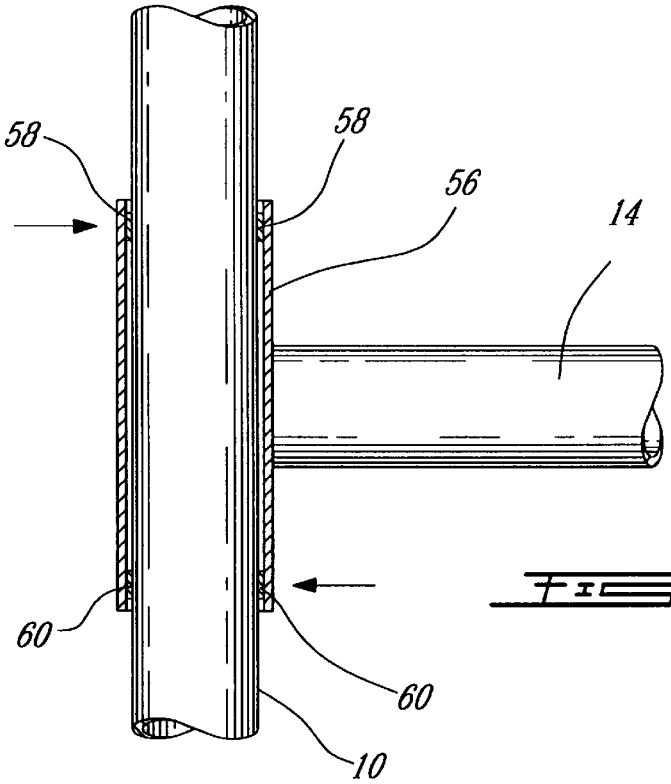
FIG. 3A is a detailed side elevational view of the mounting of the sleeve and horizontal bar on a vertical post.
Figure 3B:
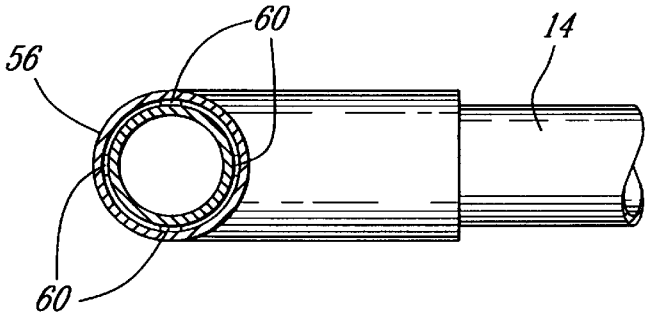
FIG. 3B is a cross sectional view of the arrangement of FIG. 3A.
Figure 3C:
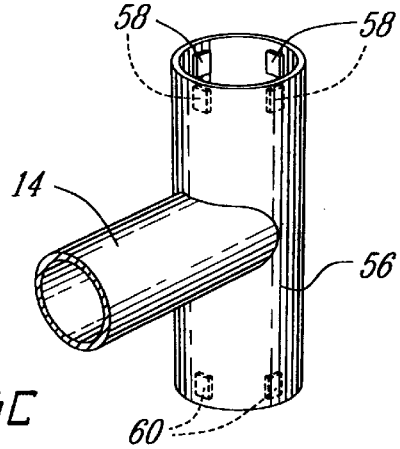
FIG. 3C is a perspective view of a sleeve for engaging a vertical post.

Vertical support posts 10 and 10' are similar and thus, only one will be described in detail herein. As may be seen in FIG. 2, in order to occupy the minimum space in a knock down condition, vertical post 10 is comprised of an upper section 20 and a lower section 22. A dowel 24 is secured inwardly of lower section 22 and is adapted to receive upper section 20. It is to be noted that the upper peripheral edge of lower section 22 and the lower peripheral edge of upper section 20 are angled, preferably at an angle of approximately 30°, such that proper positioning an alignment of upper section 20 on lower section 22 is assured.

At its upper portion, vertical post 10 is supplied with a collar 28. Mounted interiorly of vertical support post 10 is a telescopic extension arm 30 and which is vertically moveable within vertical support post 10. A pulley 32 is mounted on axle 34 so as to be rotatable. A rope 36 engages the extension arm 30 at a point 37 located at the lower portion of telescopic extension arm 30 (e.g. engage a lower pulley). Rope 36 is entrained about pulley 32 and terminates in a pull chain 38 which extends exteriorly of vertical support post 10.

The means for locking telescopic extension arm 30 in the position comprises a locking member having a general V-shaped configuration. The locking member is mounted about a pivot point 42 with the member being moveable as indicated by arrow 44. Arm 46 is biased outwardly by a suitable spring such that arm 40 bears against telescopic extension arm 30 in an angular relationship to thereby permit upward movement of telescopic extension arm 30 but prevent downward movement thereof so long as spring pressure is exerted on arm 46.

At the upper end of telescopic extension arm 30 there is provided pressure (e.g. force indicating) rod 50 which is mounted interiorly of telescopic extension arm 30 and is biased outwardly by means of a coil spring 52; i.e. the extension arm 30 comprises a sleeve element in which is mounted rod 50 and spring 52, the rod 50 extending outwardly at a distal end of the sleeve element.

Horizontal bar 14 has a center indicating marking 90 and is mounted on vertical support members 10, 10' by means of sleeves 56 and 56' respectively. Again, sleeves 56 and 56' are similar and thus only one will be described in detail herein.

A problem encountered in vertical movement of most horizontal bars is that the length of bar is substantial compared to the vertical length of sleeves and therefore a pinching or jamming action occurs. In order to overcome this, in the preferred embodiment, four upper glide members 58 are mounted within sleeve 56 to ensure smooth movement of sleeve 56 along vertical support bar 10. It will be noted that the glides 56 are spaced 90° from each other. Bottom glides 60 are provided at the bottom portion of sleeve 56 and are also spaced 90° from each other in substantially the same vertical planes as top glides 58.

In order to provide a locking action, vertical support member 10 has a plurality of apertures 64 formed therein. Apertures 64 are spaced apart a vertical distance suitable to provide the degree of adjustment required for horizontal bar 14. It will be noted that apertures 64 are spaced 45° from glides 58 and 60 to thereby prevent damage thereto during vertical movement adjustment of the horizontal bar 14. An aperture 66 is also provided within sleeve 56.

Figure 4A:
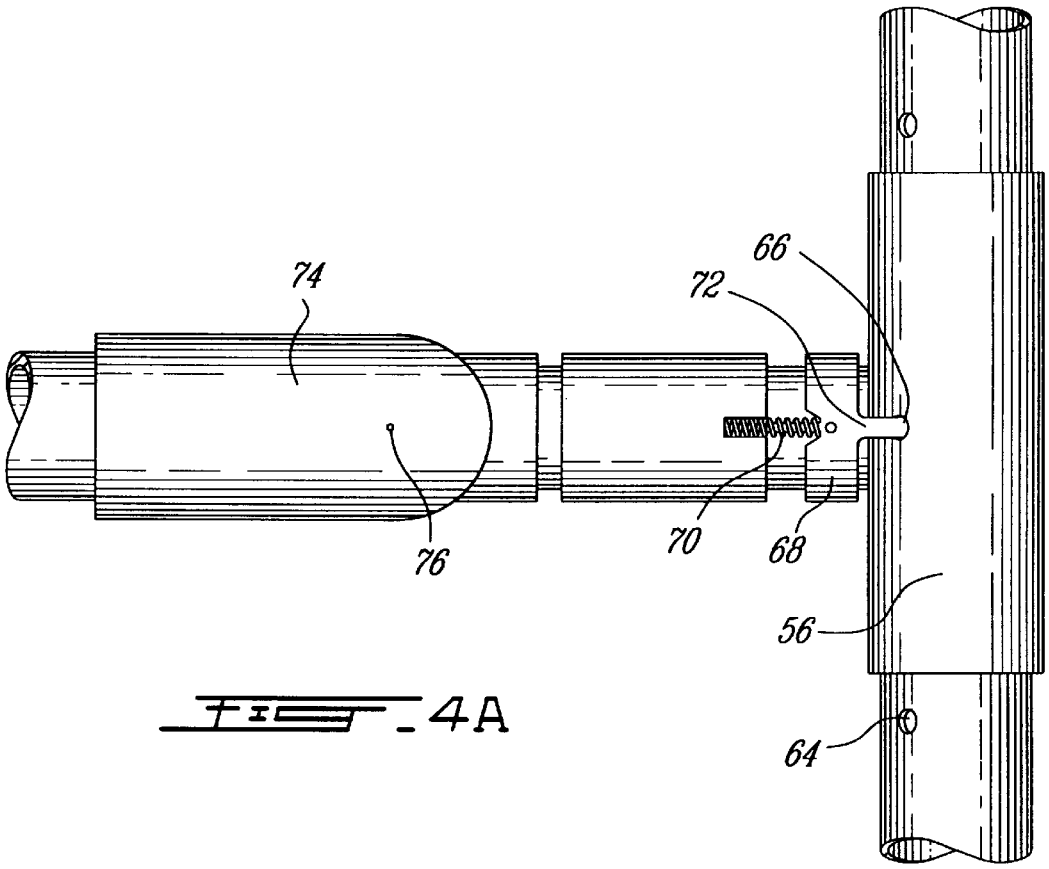
FIG. 4A is a side elevational view of the sleeve portion and associated locking arrangement.
Figure 4B:
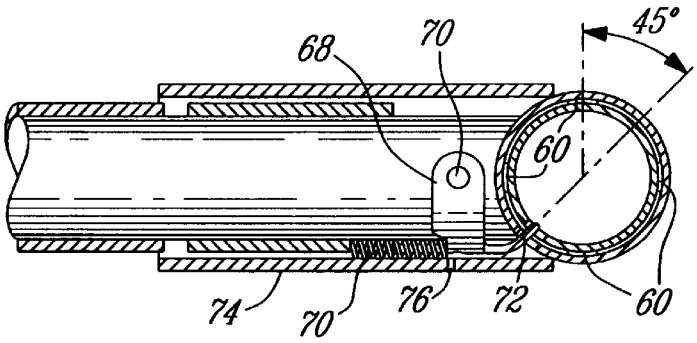
FIG. 4B is a cross sectional view of FIG. 4A.
Figure 5:
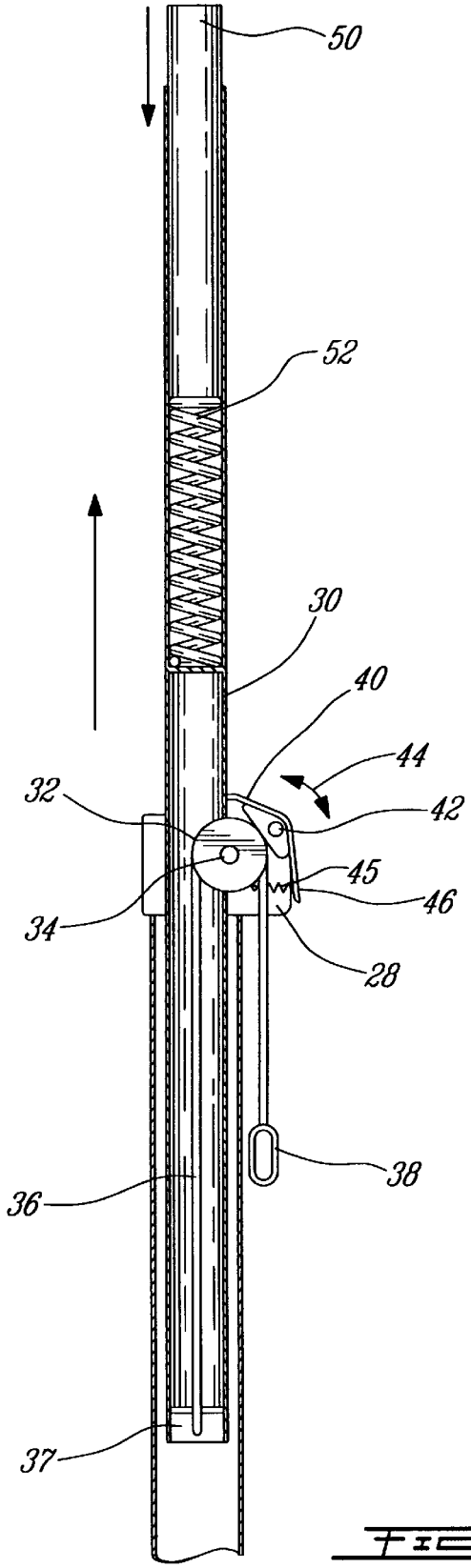
FIG. 5 is a side elevational view of a vertical post illustrating a telescopic extension arm and the adjustment thereof.

A locking member 68 is mounted so as to be pivotable about a pivot point 70 and has a locking pin 72 sized to fit within apertures 56 and 64. A tubular handle 74 extends about an end of horizontal bar 14 and has a lock engaging member 76 such that movement, in the right hand direction as seen in FIG. 4B, will cause locking pin 72 to enter apertures 66 and 64 to maintain the horizontal bar in position. A reverse movement to the left will allow for compression of a biassing component such as an helicoidal spring 70 to cause disengagement of locking pin 72 from within apertures 64 and 66 and thereby permit adjustment of horizontal bar 14.

For engagement with the floor 11, and as may be seen in FIG. 1, each vertical support post 10 and 10' is provided with shoes 80, 80' respectively. Shoes 80 and 80' are substantially identical. As may be seen in FIG. 1, shoe 80 has a recess adapted to receive vertical support post 10. Vertical support post 10 has, in turn, a U-shaped recess generally designated by reference numeral 82 to fit over a pin 84. Pin 84 ensures that there is no rotational movement of vertical support post 10 which would cause misalignment of the device.

In operation, the device may be assembled on the ground or floor and then brought into a vertical position. Final vertical adjustment can be made by the use of chain 38 and rope 36 for vertical movement of telescopic extension arm 30. In this respect, chain 38 may be pulled until pressure rod 50 is pushed within telescopic extension arm 30 by the ceiling 12 to a desired degree. Preferably, pressure rod 50 may have indicia thereon to indicate a desired amount of pressure which is to be exerted on ceiling 12. At the same time, ring 9 functions as a plumb line to ensure the vertically of vertical support post 10.

It will be understood that the above described embodiments are for purposes of illustration only and that changes and modifications may be made thereto without departing from the spirit and scope of the invention.

I claim:

1. In a horizontal bar exercising device for use in a room having a floor and a ceiling, the device comprising first and second support posts, a horizontal bar having first and second ends, and correcting means connecting said horizontal bar at each end thereof to a respective support post, said first and second support posts being designed to extend vertically between said floor and ceiling, said support posts each having a ceiling end and a floor end, the improvement wherein said device comprises a pair of extension arms, and a pair of releasable locking means each releasable locking means being associated with a respective extension arm for locking the extension arm in an extended position, each extension arm being associated with a respective cable means and a respective cable mounting means, each support post having a tubular configuration such that the support post has an interior communicating with an opening at said ceiling end, each extension arm being telescopically mounted with respect to the interior of a respective support post, the cable means and the cable mounting means associated with each extension arm being configured and disposed such that a portion of the cable means is exterior of a respective post and the cable means extends into the interior of the respective post and engages the respective extension arm such that by pulling on the portion of the cable means exterior of the respective post such pulling induces the cable means to urge the respective extension arm out of the interior of the respective post through the opening at the ceiling end thereof to an extended position.

2. A horizontal bar exercising device as defined in claim 1 wherein each releasable locking means associated with a respective extension arm comprises a pivotally mounted lever member and spring bias means, said lever member and spring bias means being configured and mounted on a respective support post such that said lever element is displaceable between an arm locking configuration wherein a contact element of the lever member is biassed in locking contact with the extension arm and an arm release configuration wherein the contact element is spaced form said extension arm.

3. A horizontal bar exercising device as defined in claim 1 comprising, pulley means located at the ceiling end of each of said support posts, the cable means associated with each extension arm extending from a lower end of a respective extension arm about a respective pulley means to a location exterior of a respective post.

4. A horizontal bar exercising device as defined in claim 1 wherein each said extension and comprises a sleeve element and a pressure rod element telescopically mounted within said sleeve element, said pressure rod element being biassed outwardly at a distal end of said sleeve element.

5. A horizontal bar exercising device as defined in claim 4 wherein each of said pressure rod elements is biassed outwardly by a spring means located within a respective sleeve element.

6. A horizontal bar exercising device as defined in claim 1 comprising a pressure beam designed to engage the ceiling and extending between distal ends of said extension arms.

7. A horizontal bar exercising device as defined in claim 5 comprising a pressure beam designed to engage the ceiling and extending between distal ends of said extension arms.

8. A horizontal bar exercising device as defined in claim 1 wherein said connecting means comprises first and second sleeve members, a pair of releasable locking components, and first and second friction reducing means, said first sleeve member interconnecting said first post and said first end of said horizontal bar, said second sleeve member interconnecting said second post and said second end of said horizontal bar, said sleeve members being respectively slidable along said first and second posts, said first and second friction reducing means each being interposed between a respective sleeve member and a respective post, and each releasable locking component being associated with a respective end of the horizontal bar for locking the respective end of the horizontal bar to a respective support post in predetermined position.

9. A horizontal bar exercising device as defined in claim 8 wherein said first and second friction reducing means each comprises glide members on an interior surface of a respective sleeve member.

10. A horizontal bar exercising device as defined in claim 8 wherein said first and second friction reducing means each comprise four spaced apart glide elements, each glide element comprising an upper glide member and a lower glide member, each upper glide member being vertically aligned with and vertically spaced apart from a respective lower glide member so as to define a respective glide element.

11. A horizontal bar exercising device as defined in claim 10 wherein each of said support posts has a plurality of vertically aligned lock apertures, said vertically aligned lock apertures being disposed so as to be between a pair of guide elements.

12. A horizontal bar exercising device as defined in claim 11 comprising a pressure beam designed to engage the ceiling and extending between distal ends of said extension arms.

13. A horizontal bar exercising device as defined in claim 8 wherein each of said support posts has a plurality of vertically aligned lock apertures, wherein each of said releasable locking components comprises said vertically aligned lock apertures of a respective support post, a further sleeve member slidable along said horizontal bar, a pivotally mounted locking member disposed at a respective end of the horizontal bar, said locking member having a locking pin extended therefrom configured to fit within the lock apertures of the respective support post, said further sleeve member being connected by connecting means to the locking member, biassing means, the locking member, the further sleeve member, the biassing means and a respective sleeve member interconnecting the respective support post and the horizontal bar being configured and mounted such that the locking member is displaceable by the further sleeve member between a locking configuration wherein the locking pin thereof is biassed in locking engagement within a lock aperture and an extracted configuration wherein the locking pin is an extracted position relative to said apertures such that respective sleeve member interconnecting the respective support post and the horizontal bar is permitted to vertically slide along the respective support post.

14. A horizontal bar exercising device as defined in claim 13 wherein each of said support posts comprises an upper portion and a lower portion, said portions being secured together by means of a dowel extending from one of said portions to within another of said portions, one of said portions having a end cut at an angle with respect to the horizontal and the other of said portions having the dowel and having a ledge element of complimentary shape and angle to that of the cut end so as to engage the cut end so as to thereby permit self-aligning of the locking apertures of each of said portions.

15. A horizontal bar exercising device as defined in claim 14 wherein said first and second friction reducing means each comprises four spaced apart glide elements, each glide element comprising an upper glide member and a lower glide member, each upper glide member being vertically aligned with and vertically spaced apart from a respective lower glide member so as to define a respective glide element, said vertically aligned lock apertures being disposed so as to have a guide element on either side thereof.

16. In a horizontal bar exercising device for use in a room having a floor and a ceiling, the device comprising first and second support posts, a horizontal bar having first and second ends, and connecting means connecting said horizontal bar at each end thereof to a respective support post, and said first and second support posts being designed to extend vertically between said floor and ceiling, said support posts each having a ceiling end and a floor end, said connecting means comprising first and second sleeve members, said first sleeve member interconnecting said first post and said first end of said horizontal bar, said second sleeve member interconnecting said second post and said second end of said horizontal bar, said sleeve members being respectively slidable along said first and second posts, the improvement wherein said connecting means comprises a pair of releasable locking components, each releasable locking component being associated with a respective end of the horizontal bar for locking the respective end of the horizontal bar to a respective support post in predetermined position, and wherein each of said support posts has a plurality of vertically aligned lock apertures, wherein each of said releasable locking components comprises the vertically aligned lock apertures of a respective support post, a further sleeve member slidable along said horizontal bar, a pivotally mounted locking member disposed at a respective end of the horizontal bar, said locking member having a locking pin extended therefrom configured to fit within the lock apertures of the respective support post, said further sleeve member being connected by connecting means to said locking member, and biassing means, the locking member, the further sleeve member, the biassing means and a respective sleeve member interconnecting the respective support post and the horizontal bar being configured and mounted such that the locking member is displaceable by the further sleeve member between a locking configuration wherein the locking pin thereof is biassed in locking engagement within a lock aperture and an extracted configuration wherein the locking pin is an extracted position relative to said apertures such that respective sleeve member interconnecting the respective support post and the horizontal bar is permitted to vertically slide along the respective support post.

17. A horizontal bar exercising device as defined in claim 16 wherein each of said support posts comprises an upper portion and a lower portion, said portions being secured together by means of a dowel extending from one of said portions to within another of said portions, one of said portions having a end cut at an angle with respect to the horizontal and the other of said portions having the dowel and having a ledge element of complimentary shape and angle to that of the cut end so as to engage the cut end so as to thereby permit self-aligning of the locking apertures of each of said portions.

18. A horizontal bar exercising device as defined in claim 17 wherein said connecting means comprises first and second friction reducing means, said sleeve members being respectively slidable along said first and second posts, said first reducing means being interposed between the first respective sleeve member and a respective post, and said second friction reducing means being interposed between the second sleeve member and a respective post.

19. A horizontal bar exercising device as defined in claim 18 wherein said first and second friction reducing means each comprises four spaced apart glide elements, each glide element comprising an upper glide member and a lower glide member, each upper glide member being vertically aligned with and vertically spaced apart from a respective lower glide member so as to define a respective glide element, said vertically aligned lock apertures being disposed so as to have a guide element on either side thereof.

20. In a horizontal bar exercising device for use in a room having a floor and a ceiling, the device comprising first and second support posts, a horizontal bar having first and second ends, and connecting means connecting said horizontal bar at each end thereof to a respective support post, said first and second support posts being designed to extend vertically between said floor and ceiling, said support posts each having a ceiling end and a floor end, the improvement wherein said device comprises a pair of extension arms, a pair extension arm displacement means and a pair of releasable locking means each support post having a tubular configuration such that the support post has an interior communicating with an opening at said ceiling end, each extension arm being telescopically mounted with respect to the interior of a respective support post, each releasable locking means being associated with a respective extension arm for locking the extension arm in an extended position, each extension arm displacement means being associated with a respective extension arm for urging the respective extension arm out of the interior of the respective post through the opening at the ceiling end thereof to an extended position.

* * * * *